United States Patent [19]

Frenchik et al.

[11] 4,452,883

[45] Jun. 5, 1984

[54] BARRIER RESIN FOR PHOTOTHERMOGRAPHIC COLOR SEPARATION

[75] Inventors: Robert A. Frenchik, Somerset, Wis.; Kristen A. Hoff, Minneapolis, Minn.

[73] Assignee: Minnesota Mining and Manufacturing Company, St. Paul, Minn.

[21] Appl. No.: 495,468

[22] Filed: May 17, 1983

[51] Int. Cl.[3] ..... G03C 1/00; G03C 1/727

[52] U.S. Cl. ..... 430/502; 430/338; 430/351; 430/353; 430/619

[58] Field of Search ..... 430/502, 351, 353, 338, 430/619

[56] References Cited

U.S. PATENT DOCUMENTS

| | | | |
|---|---|---|---|
| 2,761,791 | 9/1956 | Russell | 117/34 |
| 3,531,286 | 9/1970 | Renfrew | 96/67 |
| 4,021,240 | 5/1977 | Cerquone et al. | 96/29 |
| 4,260,677 | 4/1981 | Winslow et al. | 430/618 |
| 4,283,477 | 8/1981 | Fletcher et al. | 430/451 |

FOREIGN PATENT DOCUMENTS 837095 6/1960 United Kingdom .

OTHER PUBLICATIONS

Carpenter, J. W. and Lauf, P. W., Research Disclosure No. 17029, issued Jun. 1978.

GAF Technical Bulletin 9642–070, (1967), p. 12.

*Primary Examiner*—Mary F. Downey

*Attorney, Agent, or Firm*—Donald M. Sell; James A. Smith; Lorraine R. Sherman

[57] ABSTRACT

A photothermographic color construction is disclosed, the construction having at least two color-forming layers comprising:

a. a first, spectrally-sensitized, color-forming layer coated out of a solvent system selected from lower alkyl alcohols (up to 4 carbon atoms) ketones (up to 6 carbon atoms), aromatic hydrocarbons (up to 10 carbon atoms), or mixtures thereof, b. an upper, second, different, spectrally-sensitized color-forming layer coated out of a toluene or acetone solvent system, and c. a barrier layer comprising a polymer and a color developer coated between said first and second color-forming layers, said polymer being impervious to toluene or acetone, said polymer being an admixture of a first polymer, polyvinylpyrrolidone (PVP), and a second polymer which is (i) a neutralized and (ii) a hydrolyzed or lower alkyl-esterfied form of a poly(methyl vinyl ether/maleic anhydride) copolymer, in the range of 30 weight percent PVP/70 weight percent neutralized second polymer to 75 weight percent PVP/25 weight percent neutralized second polymer (the weight percentages being of the solventless admixture) said barrier layer is impervious to the solvent system of an overlaying color-forming layer; and further wherein each color-forming layer is sensitized to a portion of the spectrum at least 60 nm different from the other color-forming layer, and each color-forming layer contains a leuco dye (colorless) which when oxidized forms a dye (colored) having a maximum absorbance at least 60 nm different from that of the dye (colored) formed in the other color-forming layer.

17 Claims, No Drawings

BARRIER RESIN FOR PHOTOTHERMOGRAPHIC COLOR SEPARATION

DESCRIPTION

1. Field of the Invention

The present invention relates to silver halide photothermographic color constructions and in particular to image enhancement and color formation in photothermographic constructions by barrier resins.

2. Background Art

Silver halide photothermographic imaging materials, often referred to as 'dry silver' compositions because no liquid development is necessary to produce the final image, have been known in the art for many years. These imaging materials basically comprise a light-insensitive, reducible silver source, a light-sensitive material which generates silver when irradiated, and a reducing agent for silver ion in the silver source. The light-sensitive material is generally photographic silver halide which must be in catalytic proximity to the light-insensitive silver source. Catalytic proximity is an intimate physical association of these two materials so that when silver specks or nuclei are generated by the irradiation or light exposure of the photographic silver halide, those nuclei are able to catalyze the reduction of the silver source by the reducing agent.

The silver source used in this area of technology is a material which contains a reducible source of silver ions. The earliest and still preferred source comprises silver salts of long chain carboxylic acids, usually of from 10 to 30 carbon atoms. The silver salt of behenic acid or mixtures of acids of like molecular weight have been primarily used. Salts of other organic acids or other organic materials such as silver imidazolates have been proposed, and U.S. Pat. No. 4,260,677 discloses the use of complexes of inorganic or organic silver salts as image source materials.

Color-forming, 'dry silver' imaging systems are known in the photographic art. Color-formation is based on the oxidation/reduction reaction between the light exposed silver salt of a fatty acid which has been halidized and dye sensitized to a specific wavelength and a chromogenic developer when heated to an elevated temperature. For example, U.S. Pat. No. 3,531,286 teaches the inclusion of color coupler components such as a p-phenylenediamine developer and a phenolic or active methylene coupler in close proximity to the light-sensitive emulsion. J. W. Carpenter and P. W. Lauf, Research Disclosure No. 17029, issued June 1978, review prior art relating to photothermographic silver halide systems which includes color formation.

Multicolor photothermographic imaging articles are known in the art with the various color forming layers (usually sets of bilayers for each color) maintained distinct from each other by the use of functional or non-functional barrier layers between the various photosensitive layers or bilayers. A barrier layer overlaying one photosensitive, photothermographic emulsion layer is insoluble in the solvent of the next photosensitive, photothermographic layer. Photothermographic articles having at least 2 or 3 distinct color image forming layers are disclosed in U.S. Pat. No. 4,021,240 and in U.S. Ser. No. 475,441, filed Mar. 15, 1983. The barrier layers are "functional" when ingredients active in the formation of color material are included therein. The barrier layers are considered "non-functional" when no ingredients active in the formation of dye images or silver images are included within that layer. U.S. Pat. No. 4,021,240 discloses barrier polymers such as polyvinyl alcohol and gelatin. The use of simultaneous multiple coatings of the color-forming layers is also disclosed. The barrier layer is monocoated.

Assignee's copending patent application, U.S. Ser. No. 475,441, filed Mar. 15, 1983, discloses color photothermographic articles in which the various color-forming layers are separated by organic solvent soluble barrier layers insoluble in the organic solvent used to coat at least one of the adjacent color-forming layers. The barrier polymer disclosed therein is a copolymer of the ethyl monoester of poly(methyl vinyl ether/maleic acid).

As just mentioned, the ethyl monoester of poly(methyl vinyl ether/maleic acid), Gantrez® ES-225 (GAF Corp.), can be used as a barrier resin. GAF Technical Bulletin 9642–070 (1967) at page 12, discloses that polyvinylpyrrolidone (PVP) crosslinks with polyacids such as polyacrylic acid or with Gantrez® ES-225 to form complexes which are insoluble in water but dissolve in dilute alkali. It is taught that an increase in pH (beyond 7) is required to solubilize the complex.

U.S. Pat. No. 2,761,791 and British Pat. No. 837,095 describe the techniques of simultaneously coating two or more layers of coating materials on a support.

SUMMARY OF THE INVENTION

The present invention comprises at least two color-forming layers, each having a leuco dye, a silver source, and silver halide therein, and each having a topcoat layer containing a color developer and, when necessary, a "barrier polymer" which is impervious to an upper adjacent color layer. For example, a yellow monocolor system is blue-sensitized. Its second layer, which usually contains the developer (such as a biphenol derivative or a triarylimidazone) whose oxidative product is yellow, could consist of a non-aqueous, organic solvent soluble, barrier polymer and a development accelerator of phthalazine and phthalic acid. It is this barrier polymer with which this invention is concerned. As already mentioned, barrier polymers must be impervious to the solvent system of an upper adjacent color construction to produce good color separation, and it is desirable that the barrier polymer also be amenable to simultaneous coating techniques. It has been found that the combination of a first polymer, i.e., polyvinylpyrrolidone, and a neutralized second polymer, which is a hydrolyzed (maleic anhydride slowly and completely hydrolyzes in the presence of water to form the free acid) or lower alkyl ($C_1$ to $C_5$)-esterfied form of a poly(methyl vinyl)ether/maleic anhydride copolymer, provides a tremendous improvement over the barrier resin, Gantrez® ES 225, used alone. "Neutralized second polymer" means replacement of sufficient acid groups in the maleic acid or maleic anhydride portion of the polymer with an amine or $NH_3$ group to provide the resin with a pH of 4.5 to 7 as measured in a 20/80 methanol/water solution. For example, 0.5 parts by weight of 20/1 Gantrez® ES 225 to 2-amino-2-methyl propanol in 99.5 parts by weight of 20/80 methanol/water solution gave a pH of approximately 4.5. The combination of polyvinylpyrrolidone and neutralized second polymer provides improved topcoat adhesion to the silver trip, improved print stability, improved flexibility, and is amenable to multiple coating techniques. In order to provide compatibility of the two polymers, the second polymer has to be partially neutralized to a pH of at least 4.5. Either 2-amino-2-methyl propanol or ammonium hydroxide is an acceptable neutralizing agent as suggested in technical bulletin 7543-115 to General Aniline and Film Corporation, page 18 (1977).

Photothermographic color constructions of the present invention incorporate at least two spectrally-sensitized color-forming layers to produce a multi-color photothermographic color recording system. The spectral sensitization may be to any pair of colors such as any two of black, yellow, red, green, blue, and purple provided that each color-forming layer is sensitized to a portion of the spectrum at least 60 nm different from the other color-forming layer, and each color-forming layer contains a leuco dye which when oxidized forms a visible dye having a maximum absorbance at least 60 nm different from that of the dye formed in the other color-forming layer. Preferred pairs of colors to which the construction may be sensitized are yellow-cyan, yellow-magenta, and cyan-magenta. A barrier polymer which is impervious to the solvent system of a color construction above it is coated between each pair of color-forming layers. Such a barrier polymer or barrier polymers are essential for the production of good color separation. This type of construction with the proper solvent selection is conducive to the use of simultaneous multiple coating techniques with good color separation. The constructions of the present invention possess the following desirable qualities:

a. barrier resin effectiveness—provides good color separation,
b. ability to multiple coat—contributes to economy and simplicity of production,
c. flexibility—insures against cracking and hazing of the product,
d. print stability—contributes to permanence of the imaged material, and
e. barrier layer topcoat adhesion—insures the imaging performance of the construction.

As mentioned above, U.S. Ser. No. 475,441, discloses use of a copolymer of the ethyl monoester of poly(methyl vinyl ether/maleic acid), Gantrez® ES 225, as a barrier polymer. However, it has been found that, after processing, the barrier layer frequently loses its adhesion and becomes brittle. The barrier layer of the present invention overcomes these shortcomings.

DETAILED DESCRIPTION

The present invention provides a photothermographic color construction having at least two color-forming layers comprising:

a. a first, spectrally-sensitized, color-forming layer coated out of a solvent system selected from lower alkyl alcohols (up to 4 carbon atoms) ketones (up to 6 carbon atoms), aromatic hydrocarbons (up to 10 carbon atoms), or mixtures thereof,
b. an upper, second, different, spectrally-sensitized color-forming layer coated out of a toluene or acetone solvent system, and
c. a barrier layer comprising a polymer and a color developer coated between said first and second color-forming layers, said polymer being impervious to toluene or acetone, said polymer being an admixture of a first polymer, polyvinylpyrrolidone (PVP), and a second polymer which is (i) a neutralized and (ii) a hydrolyzed or lower alkyl ($C_1$ to $C_5$)-esterified form of a poly(methyl vinyl ether/maleic anhydride) copolymer, in the range of 30 weight percent PVP/70 weight percent neutralized second polymer to 75 weight percent PVP/25 weight percent neutralized second polymer (the weight percentages being of the solventless admixture) said barrier layer is impervious to the solvent system of an overlaying color-forming layer; and further wherein each color-forming layer is sensitized to a portion of the spectrum at least 60 nm different from the other color-forming layer, and each color-forming layer contains a leuco dye (colorless) which when oxidized forms a dye (colored) having a maximum absorbance at least 60 nm different from that of the dye (colored) formed in the other color-forming layer.

Hydrolyzed or lower alkyl ($C_1$ to $C_5$)-esterfied forms of the poly(methyl vinyl ether/maleic anhydride), referred to as second polymer herein, preferably can be selected from the following polymers, available from GAF® Corp:

| | |
|---|---|
| poly(methyl vinyl ether/maleic anhydride), low-, medium-, and high-viscosity types | Gantrez® AN-119, 139, 149, 169, 179 |
| poly(methyl vinyl ether/maleic acid), hydrolyzed, low/high mol/wt | Gantrez® S-95/97 |
| monoethyl ester of poly-(methyl vinyl ether/maleic acid) | Gantrez® ES-225 |
| monoisopropyl ester of poly(methyl vinyl ether/maleic acid) | Gantrez® ES-335 |
| monobutyl ester of poly(methyl vinyl ether/maleic acid), 50% ethanol solution/50% isopropanol solution | Gantrez® ES-425/435 |

The monoethyl ester of poly(methyl vinyl ether/maleic acid), Gantrez® ES-225, is the most preferred second polymer.

The photothermographic color construction may comprise three different monocolor-forming layers to provide a 3-color forming system. The first color-forming layer may be coated out of a lower alkyl alcohol solvent system. The barrier layer of the present invention which is impervious to toluene or acetone can be used as a barrier to a second (or upper) color forming layer which is coated out of toluene or acetone. Between this two-color, three layer, construction and an overlying third color alcohol solvent system, a second barrier layer is used, which barrier layer should be impervious to alcohol. For example, the copolymer of the ethyl monoester of poly(methyl vinyl ether/maleic anhydride) as disclosed in the above-mentioned U.S. Ser. No. 475,441, is a barrier layer impervious to alcohol. Additional color-forming layers may be added above or below this 2-color system, but in each case a barrier layer is used which is impervious to the solvent of the color-forming layer above it. The barrier layer of the present invention, because of its excellent film-forming properties, resistance to abrasion, flexibility, and print stability, makes a superior topcoat layer even when no color-forming layer is used above it.

Useful lower alkyl alcohol solvent systems for color-forming or barrier layers include at least 50 weight percent lower alkyl alcohols ($C_1$ to $C_4$). Methanol is the preferred solvent since it provides complete compatibility of the polymers after neutralization. Although 100 percent methanol is the most preferred solvent system, other barrier topcoat solvent mixtures can be used so long as the major component of the solvent system is a lower alkyl alcohol which include the following:

1. methanol-ethanol, with no more than 50 weight percent ethanol;
2. ethanol-methanol-toluene, various combinations with methanol concentration no lower than 25 weight percent, and toluene no greater than 33 weight percent; and
3. ethanol-methanol-methyl ethyl ketone, various combinations with methanol present in an amount no less than 25 weight percent and methyl ethyl ketone no greater than 33 weight percent.

Aromatic hydrocarbons of up to 10 carbon atoms, such as toluene, xylene, cyclohexane, or volatile aliphatic ketones such as acetone or methyl ethyl ketone are useful diluent solvents used to improve wetting and drying characteristics. Toluene or acetone solvent systems for color-forming layers and methyl methacrylate barrier layers include these solvents or mixtures thereof.

In the present invention, the ratio of polyvinylpyrrolidone to the neutralized second polymer present is in the range of 30 weight percent PVP/70 weight percent neutralized second polymer to 75 weight percent PVP/25 weight percent neutralized second polymer and preferably the range is 55 weight percent PVP/45 neutralized second polymer to 69 weight percent PVP/31 weight percent neutralized second polymer. Combination concentrations outside these ranges have negative effects on the barrier resin, adhesion, or brittleness properties.

The coatings can either be coated as single layers, as for example by knife-coating or extruding, and dried before the next layer is applied or each monocolor can be dual coated, as for example by dual slide-coating or dual extrusion, i.e., each of the sensitized silver layers with its respective topcoat, which may contain a barrier resin, can be coated together to reduce the number of passes through the coater. This is a point where aqueous coatings of gelatine and polyvinyl alcohol particularly fail by being incompatible with organic solvent-containing coatings.

The silver source material, as mentioned above, may be any material which contains a reducible source of silver ions. Silver salts of organic acids, particularly long chain (10 to 30, preferably 15 to 28, carbon atoms) fatty carboxylic acids are preferred. Complexes of organic or inorganic silver salts wherein the ligand has a gross stability constant for silver ion of between 4.0 and 10.0 are also desirable. The silver source material should constitute from about 5 to 70 and preferably from 7 to 30 percent by weight of the imaging layer. The second layer in a two-layer construction would not affect the percentage of the silver source material desired in the single imaging layer.

The silver halide may be any photosensitive silver halide such as silver bromide, silver iodide, silver chloride, silver bromoiodide, silver chlorobromoiodide, silver chlorobromide, etc., and may be added to the emulsion layer in any fashion which places it in catalytic proximity to the silver source. The silver halide is generally present as 0.75 to 15 percent by weight of the imaging layer, although larger amounts up to 20 or 25 percent are useful. It is preferred to use from 1 to 10 percent by weight silver halide in the imaging layer and most preferred to use from 1.5 to 7.0 percent.

The preferred reducing agent (developer) for silver ion used in the present invention is a biphenol derivative or a triarylimidazone which will reduce silver ion to metallic silver and produce a colored quinone. Conventional photographic developers such as phenidone, hydroquinones, and catechol are useful in minor amounts, and hindered phenol reducing agents may also be added. The reducing agent should be present as 1 to 10 percent by weight of the imaging layer. In a two-layer construction, if the reducing agent is in the second layer, slightly higher proportions, of from about 2 to 15 percent, tend to be more desirable.

Toners such as phthalazinone, phthalic acid and derivatives thereof, and both phthalazine and phthalic acid, and others known in the art, are not essential to the construction, but are highly desirable. These materials may be present, for example, in amounts of from 0.2 to 5 percent by weight.

The binder for the silver coating is selected from well-known natural and synthetic resins such as gelatin, polyvinyl acetals, polyvinyl chloride, polyvinyl acetate, cellulose acetate, ethyl cellulose, polyolefins, polyesters, polystyrene, polyacrylonitrile, polycarbonates, methacrylate copolymers, maleic anhydride ester copolymers, and butadiene-styrene copolymers, and the like. When simultaneous coating of layers is used, the binder is selected to coordinate with the solvent used. Copolymers and terpolymers which include the above-stated binders are of course included in these definitions. The preferred photothermographic silver containing binder is polyvinyl butyral. The binders are generally used in a range of from 20 to 75 percent by weight of each layer, and preferably about 30 to 55 percent by weight.

The leuco dyes and dye forming developers used in the present invention may be any colorless or lightly colored compound which forms a visible dye upon oxidation. The compound must be oxidizable to a colored state. Compounds which are both pH sensitive and oxidizable to a colored state are useful but not preferred, while compounds only sensitive to changes in pH are not included within the term "leuco dyes" since they are oxidizable to a colored form.

The dyes formed from the leuco dyes in the various color-forming layers should of course be different. A difference of at least 60 nm in reflective or transmissive maximum absorbance is required. Preferably the absorbance maximum of dyes formed will differ at least 80 or 100 nm. When three dyes are to be formed, two should differ by at least these minimums, and the third should differ from at least one of the other dyes by at least 150 nm and preferably at least 200 or even at least 250 nm. This will provide a good, full color range for the final image.

Any leuco dyes capable of being oxidized by silver ion to form a visible image is useful in the present invention as previously noted. Dye forming developers such as those disclosed in U.S. Pat. Nos. 3,445,234; 4,021,250; 4,022,617 and 4,368,247 are useful. The dyes listed in Japanese Kohyo National Publication No. 500352/82, published Feb. 25, 1982 are useful. Preferred dyes are described in the above-mentioned patent application, U.S. Ser. No. 475,441, and are incorporated herein by reference. To modify the development rate or color, development modifiers, present in a range of 0.1 to 1.0 weight percent of the coating solution can be used. Representative development modifiers include aromatic carboxylic acids and their anhydrides such as phthalic acid, 1,2,4-benzenetricarboxylic acid, 2,3-naphthalene dicarboxylic acid, tetrachlorophthalic acid, 4-methyl phthalic acid, homophthalic acid, 4-nitro phthalic acid, o-phenylacetic acid, naphthoic acid, naphthalic acid, phthalic anhydride, naphthalic anhydride, tetrachlorophthalic anhydride, and the like.

The test for determining if a barrier polymer is impermeable to the solvent of the next layer can be simply performed. First a layer containing a sensitized, halidized silver salt of a fatty carboxylic (e.g., 10–32 carbon atoms, preferably 12–29 carbon atoms) acid and polyvinyl butyral polymer is coated. A second coating of the candidate barrier polymer is applied after the first coating has dried. The last layer contains the appropriate solvent, a color forming developer, and toner reactants. The dried coatings are given an excessive light exposure and then heated for 60 seconds at 124°–138° C. (255°–280° F.). The test is positive if no color or image is formed.

The following test methods were employed for evaluation of the photothermographic constructions:

1. Barrier Resin Effectiveness—The test for a barrier polymer was to first coat a layer containing a sensitized silver salt of a fatty acid and polyvinyl butyral polymer. A second coating of the polymer to be tested was applied after the first coating had dried. The last layer contained the solvent to be tested, a color forming developer, and toner reactants. The dried coatings were given an excessive light exposure and then heated for 60 seconds at 108° C. (225° F.). The test was positive if no color or image was formed.

2. Flexibility—A 15 by 4 centimeter sample was run along a 90° surface angle. The sample was inspected for possible cracking or peeling.

3. Print Stability—Mono-coated samples were placed in a light box and evaluated at various intervals up to two hours. Light box conditions: 2,000 foot candles per second, 80° C., 60 percent relative humidity.

4. Barrier Topcoat Adhesion to Silver Trip—An area free of blemishes and minor surface imperfections was selected. With a razor blade, six 1.9 cm (¾-inch) long cuts were made approximately 2.54 cm apart. An additional number of cuts were made at 90 degrees, to and centered on, the original cuts. The center of a 7.6 cm (3-inch) transparent tape (Scotch ®, 3M) strip was then placed over the grid. To ensure good contact with the topcoat, the tape was firmly rubbed with an eraser on the end of a pencil. Approximately 60 seconds after application the tape was removed by seizing the free end and rapidly pulling (not jerking) off as close to an angle of 180 degrees as possible. The grid area is then inspected for removal of coating.

Sensitizing Dyes Used In Examples

454

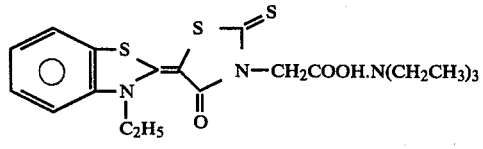

-continued

Erythrosin

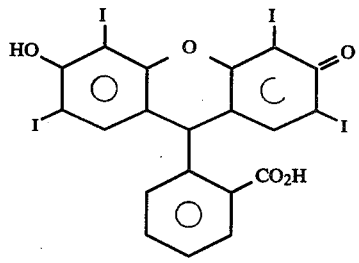

Silver Solution Preparation Procedures

A dispersion of a silver behenate half soap was made at 10 percent solids in toluene and ethanol using two passes with a "Gaulin" (Manton-Gaulin 15M 8TBA SMD model) homogenizer. A silver soap dispersion was then prepared for coating by the addition of ethanol, halide, resin, and sensitizing dye in a selected sequence of time and mixing. Three silver dispersions will be described and they were used in the following examples to illustrate the present invention. Silver Dispersion (A) uses a methanol-toluene solvent system. Silver Dispersion (B) uses a methanol-toluene solvent system and includes color-forming developer and modifiers. Silver Dispersion (C) uses a toluene solvent system and a different polyvinyl butyral resin than (A).

(A) Silver Dispersion

| Charge | Material | Amount | Mixing Time (Min.) |
|---|---|---|---|
| A | Silver Dispersion | 127 g | |
| B | Toluene | 160 g | 10 |
| C | 10% polyvinylbutyral resin, m.w. 180,000-270,000, Butvar ® B-72 (Monsanto Corp.)/methanol | 1 cc | 5 |
| D | 4 g Hg acetate/100 cc methanol | 3 cc | 10 |
| E | 0.36 g $HgBr_2$/100 cc methanol | 3 cc | 5 |
| F | 4 g $CaBr_2$/100 cc methanol | 3 cc | 45 |
| G | 10% Butvar ® B-72/methanol | 1 cc | 15 |
| H | 0.36 g $HgBr_2$/100 cc methanol | 3 cc | 5 |
| I | 4 g $CaBr_2$/100 cc methanol | 3 cc | 120 |
| J | Butvar ® B-72 | 28 g | 30 |
| K | 10% Butvar ® B-72/methanol | 343 g | 55 |

0.0146 grams of 454 blue sensitizing dye was dissolved in 6.43 grams of methanol and was then added 30 minutes later with mixing.

(B) Silver Dispersion

The procedure was the same as in (A) except for the addition of the following after charge K:

3.64 g AM-25 (6,6'-di-tert-butyl-4,4'-bi-o-cresol (Ethyl Corp.))
1.82 g phthalic acid
1.62 g phthalazine
0.67 g 4-methyl phthalic acid
160.55 g methanol These additional materials were dissolved and mixed into the silver solution for 10 minutes. The dye level was the same as previously described in (A).

(C) Silver Dispersion

The procedure was the same as in (A) except for the following charges:

| CHARGE | MATERIAL | AMOUNT |
|---|---|---|
| C | 10% Butvar B76/toluene | 1 cc |
| G | 10% Butvar B76/toluene | 1 cc |
| J | Butvar B76 | 28 g |
| K | 10% Butvar B76/toluene | 343 g |

0.0004 g of Erythrosin, a green sensitizing dye, dissolved in 2 milliliters of methanol, was added 30 minutes later to 100 g of silver dispersion (C) with mixing.

Barrier Topcoat Solution Preparation Procedure

The following formulations were used as topcoat solutions for the silver coatings:

(D) Barrier topcoat (present invention)
9.54 grams 2,6,2',6'-dimethylbiphenol
0.27 grams phthalic acid
0.24 grams phthalazine
23.82 grams methanol The above materials were dissolved and added to the following resin mixture:

76.9 grams methanol
12.5 grams 50 percent Gantrez® ES 225 (EMP)/ethanol, premixed for 30 minutes with 0.28 grams 2-amino-2-methyl-propanol
7.5 grams polyvinylpyrrolidone, PVP (GAF Corp.)

(E) Barrier topcoat (control)
0.2 grams phthalazine
0.6 grams 2,6,2',6'-dimethylbiphenol
0.2 grams phthalic acid
0.1 grams 4-methyl phthalic acid
65.8 grams ethanol The above materials were dissolved and added to 50 grams of 50 percent Gantrez® ES 225 (EMP) in ethanol.

(F) Barrier topcoat
0.6 grams 2,6,2',6'-dimethylbiphenol
0.4 grams phthalazine
0.2 grams phthalic acid
7.9 grams acetone
7.9 grams ethanol The above materials were dissolved and added to 5 grams of polyvinylpyrrolidone in 95 grams ethanol.

(G) Barrier topcoat
0.54 grams 2,6,2',6'-dimethylbiphenol
0.27 grams phthalic acid
0.24 grams phthalazine
0.10 grams 4-methyl phthalic acid
23.82 grams methanol The above materials were dissolved and mixed for 30 minutes and then added to 100 grams of the following resin solution:

10 grams Gantrez® S-97
90 grams methanol
22 grams 2-amino-2-methyl-propanol (H) Barrier topcoat
0.54 grams 2,6,2',6'-dimethylbiphenol
0.27 grams of phthalic acid
0.24 grams phthalazine
0.10 grams 4-methyl phthalic acid
23.82 grams methanol The above materials were dissolved and added to the following resin mixture:

7.5 grams PVP in 67.5 grams methanol
2.5 grams Gantrez® S-97 in 22.5 grams methanol premixed for 30 minutes with 0.55 grams 2-amino-2-methyl-propanol (I) Barrier topcoat
0.54 grams 2,6,2',6'-dimethylbiphenol
0.27 grams phthalic acid
0.24 grams phthalazine
0.10 grams 4-methyl phthalic acid
23.82 grams methanol The above materials were dissolved and added to the following resin mixture:

7.5 grams PVP, 29.0 grams methanol and 38.5 grams distilled water
6.25 grams EMP in 9.4 grams methanol and 9.4 grams ethanol premixed for 30 minutes with 0.28 grams 2-amino-2-methyl-propanol (J) Barrier topcoat 50 grams distilled water and 14 grams Gelvatol® 20–30 (polyvinyl alcohol) were mixed at room temperature. Polyvinyl alcohol was added slowly to water while stirring rapidly, and then mixing for 30 minutes. The mixture was placed on a steam bath for 60 minutes with minimum stirring. 14.5 grams distilled water with 21.5 grams isopropyl alcohol was premixed and stirred with the polyvinyl alcohol mixture while heating at 88°–94° C. (190°–200° F.) and mixing for 10 minutes. After cooling 13.6 grams distilled water, 9.1 grams isopropyl alcohol, 0.12 grams 2-ethyl-1-hexanol, and 0.22 grams anionic surfactant of the sodium-alkylaryl ether sulfate type were added. The entire solution was mixed for 10 minutes.

The following examples were used to compare properties of various yellow monocolor photothermographic systems. All examples were mono and/or dual coated (simultaneous coating of both silver and barrier topcoat solutions in one pass using two coater heads) onto a polyester base in the same manner. Coating and exposure methods were:

Monocoat:
Silver trip coating weight—8.5 g per $m^2$
Barrier topcoat orifice—0.0762 mm (3 mils)
Drying time—3 minutes silver trip, —5 minutes topcoat
Oven temperature—77° C. (170° F.) both trips Dual Coat:
Silver trip coating weight—8.5 g per $m^2$
Barrier topcoat orifice—0.0762 mm (3 mils)
Drying time—6½ minutes
Oven temperature—77° C. (170° F.)

Exposure:
P-11 is a $10^{-3}$ second exposure to a blue filtered (peak at 450 nanometers) xenon flash. Xenon flash is a $10^{-3}$ second exposure from a EG&G mark. A continuous density wedge was used to record sensitometric results.

EXAMPLE 1

(Control)

A photothermographic imaging system was prepared with barrier topcoat (E) coated over silver dispersion (A). The system was given a P-11 exposure, and developed for 25 seconds at 255° F. (124° C.). Print stability data were as follows:

| Type of Coating | Hours in light box | Dmin | Dmax | Gamma Angle | Ergs at 0.6 density units above fog |
|---|---|---|---|---|---|
| Mono | 0 | .18 | 1.49 | 42.29 | 24.81 |
| | ½ | .26 | 1.43 | 36.69 | 39.97 |

-continued

| Type of Coating | Hours in light box | Dmin | Dmax | Gamma Angle | Ergs at 0.6 density units above fog |
|---|---|---|---|---|---|
| | 2 | .27 | 1.28 | 33.74 | 67.54 |

Print stability rating—Poor
Other properties are as follows:
Barrier topcoat adhesion to silver strip—poor
Flexibility—poor
Barrier topcoat E acting as barrier resin to magenta color system—excellent barrier
Ability to simultaneously coat—bad, uneven coating pattern due to incompatibility. No sensitometric data was obtained.

EXAMPLE 2

A yellow monocolor system (useful in the present invention) consisting of silver dispersion (A) and barrier topcoat (D) was prepared. Development was for 15 seconds at 124° C. (255° F.) with a P-11 exposure. Print stability data were as follows:

| Type of Coating | Hours in light box | Dmin | Dmax | Gamma Angle | Ergs at 0.6 density units above fog |
|---|---|---|---|---|---|
| Mono | 0 | .19 | 1.60 | 52.42 | 74.15 |
| | ½ | .20 | 1.56 | 50.69 | 86.75 |
| | 1 | .21 | 1.56 | 53.80 | 100.29 |
| | 2 | .21 | 1.51 | 55.69 | 114.42 |

Print stability rating—good
Other properties are as follows:
Barrier topcoat adhesion to silver trip—very good
flexibility—very good
Barrier topcoat D acting as barrier resin to magenta color system—excellent
ability to simultaneous coat—excellent
Simultaneously coated layers (A) and (D) provided sensitometric data as follows:

| Dmin | Dmax | Gamma angle | Ergs at 0.6 density units above fog |
|---|---|---|---|
| 0.22 | 1.78 | 62.34 | 68.17 |

This data shows that an imagining system within the present invention gives better print stability, adhesion, and flexibility than the control of Example 1. In contrast to the sample of Example 1, the layers of the sample of Example 2 were successfully simultaneously coated.

EXAMPLE 3

Barrier topcoat (F) was coated over silver trip (A), given a P-11 exposure, and developed for 8 seconds at 124° C. (255° F.). Print stability results were as follows:

| Type of Coating | Hours in light box | Dmin | Dmax | Gamma Angle | Ergs at 0.6 density units above fog |
|---|---|---|---|---|---|
| Mono | 0 | .30 | 1.78 | 49.02 | 23.03 |
| | 1 | .26 | 1.67 | 50.47 | 28.40 |
| | 2 | .24 | 1.59 | 50.73 | 31.32 |

Print stability rating—Excellent
Other properties are as follows:
Barrier topcoat adhesion to silver trip—excellent
Flexibility—excellent
PVP barrier topcoat acting as barrier resin to magenta color system (must be excellent to be a possible topcoat resin)—poor, slight magenta observed
The data show that by itself polyvinylpyrrolidone was not a viable barrier topcoat resin system.

EXAMPLE 4

It is known that a polyvinyl alcohol layer containing colloidal silver is used in a photothermographic system comprising multiple color layers. Barrier topcoat (J) was coated over silver dispersion (B), given an EG&G exposure, and developed for one minute at 124° C. (255° F.). Print stability data were as follows:

| Type of Coating | Hours in light box | Dmin | Dmax | Gamma Angle | Ergs at 0.6 density units above fog |
|---|---|---|---|---|---|
| Mono | 0 | .36 | 1.73 | 51.80 | 650.64 |
| | ½ | .44 | 1.71 | 50.57 | 823.77 |
| | 1 | .47 | 1.70 | 49.90 | 708.00 |
| | 2 | .59 | 1.67 | 49.15 | 932.83 |

Print stability rating—poor
Due to the incompatibility with the organic solvent containing silver trip, the aqueous coating of polyvinyl alcohol was not able to be simultaneously coated. Downweb and crossweb streaks occurred in the dual coated sample.
Other properties were as follows:
Barrier topcoat adhesion to silver trip—excellent
Flexibility—excellent
The data show that polyvinyl alcohol (barrier topcoat I) was not a viable topcoat system due to its inability to be simultaneously coated and poor light sensitivity.

EXAMPLE 5

Barrier topcoat (I) was coated over silver dispersion (A), given an EG&G exposure and developed at 124° C. (255° F.).
Print stability data were as follows:

| Type of Coating | Seconds Development | Hours in light box | Dmin | Dmax | Gamma Angle | Ergs at 0.6 density units above fog |
|---|---|---|---|---|---|---|
| Mono | 45 | 0 | .19 | 1.30 | 46.60 | 38.30 |
| | | ½ | .20 | 1.22 | 45.51 | 50.81 |
| | | 1 | .20 | 1.31 | 49.30 | 43.50 |
| | | 2 | .21 | 1.44 | 51.54 | 43.60 |

Print stability rating—excellent
Other properties are as follows:
Barrier topcoat adhesion to silver trip—fair
Flexibility—fair Ability to simultaneously coat—fair to good, slight downweb streaks occurred.

Sensitometry results are: Dmin—0.12, Dmax—1.09, gamma angle-42.52, ergs at 0.6 above fog—694

The data show that the EMP/polyvinylpyrrolidone barrier resin topcoat containing 50 percent $H_2O$ can be simultaneously coated (50 percent water was the maximum amount useful in view of compatibility).

EXAMPLE 6

Barrier topcoat (H) was coated over silver dispersion (A), given an EG&G exposure, and developed for 15 seconds at 124° C. (255° F.). Print stability results were as follows:

| Type of Coating | Hours in light box | Dmin | Dmax | Gamma Angle | Ergs at 0.6 density units above fog |
|---|---|---|---|---|---|
| Mono | 0 | .37 | 1.13 | 22.22 | 5193 |
| | ½ | .27 | .95 | 22.95 | 2513 |
| | 2 | .27 | .80 | 18.83 | xxxx |

Print stability rate—good

Other properties are as follows:

Barrier topcoat adhesion to silver trip—very good

Flexibility—excellent

Barrier topcoat acting as barrier resin to magenta color system—excellent

The data illustrates that the use of a hydrolyzed maleic anhydride/vinyl methyl ether copolymer, in combination with polyvinylpyrrolidone, also provides a useful barrier polymer in a photothermographic color system.

EXAMPLE 7

A two color recording system utilizing the present invention barrier layer was prepared by coating four layers in the following manner.

The first layer contained 0.0042 g of 454, a blue sensitizing dye dissolved in 6 milliliters of methanol which was then added to 100 g of silver dispersion (A). This was coated at a 0.76 mm (3 mil) orifice and dryed.

The second layer was coated at a 0.10 mm (4 mil) orifice and acted as the barrier to the upper next two layers. This layer consisted of 0.3 g 2,6,2',6'-dimethylbiphenol 0.04 g phthalic acid 0.08 g 4-methyl phthalic acid 0.10 g phthalazine 9.53 g methanol which were dissolved and added to the following resin mixture:

80 g methanol 12.5 g 50 percent EMP/ethanol premixed for 30 minutes with 0.28 g 2-amino-2-methyl-propanol 7.5 g polyvinylpyrrolidone The EMP was combined with the amine before the PVP addition. After this coating was dryed, the third layer, silver dispersion (C), was applied at a 0.076 mm (3 mil) orifice.

The fourth layer, applied after the third layer was dried, was applied at a 0.076 mm (3 mil) orifice and consisted of the following:

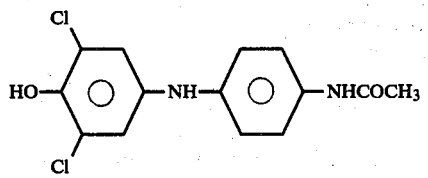

Part 1 and 2 were predissolved and mixed. This was added to 25 g of the following resin premix:

15 g Acryloid TM -A21 (30% solids in 90 toluene/10 butanol) (methyl methacrylate polymer, Union Carbide)

15 g Acryloid TM -B44 (methyl methacrylate copolymer, Union Carbide)

70 g Toluene.

After the fourth layer was dried, a print was made of a continuous wedge by exposure for $10^{-3}$ seconds Xenon light source of an EGG Mark VII sensitometer using narrow band filters of peak transmission of 450 and 540 nm to give a yellow-colored image at 450 nm and a magenta image at 540 nm, the samples were processed for 20 seconds at 124° C. The resulting colored wedges were run on a computer densitometer using the blue filter for the yellow image and the green filter for the magenta image. The following results were obtained:

| Filter Response | Wratten Green (Eastman Kodak) | Wratten 47B Blue |
|---|---|---|
| Dmin | 0.17 | 0.23 |
| Dmax | 1.70 | 1.89 |
| gamma angle | 53 | 61 |
| ergs/cm$^2$ at 1.0 density above fog | 46 | 17 |
| Image color | Magenta | Yellow |

The data of this Example show good color separation between the magenta and yellow layers, illustrating the usefulness of the present invention barrier layer.

Various modifications and alterations of this invention will become apparent to those skilled in the art without departing from the scope and spirit of this invention, and it should be understood that this invention is not to be unduly limited to the illustrative embodiments set forth herein.

We claim:

1. A photothermographic color construction having at least two different mono-color-forming layers comprising:

a. a first, spectrally-sensitized, color-forming layer coated out of a solvent system selected from lower alkyl alcohols, aliphatic ketones, aromatic hydrocarbons, or mixtures thereof, b. an upper, second, different, spectrally-sensitized, color-forming layer coated out of a toluene or acetone solvent system, and c. a barrier layer comprising a polymer and a color developer coated between said first and second color-forming layers, said polymer being impervious to toluene or acetone, said polymer being an admixture of a first polymer, polyvinylpyrrolidone, and a second polymer which is (i) a neutralized and (ii) a hydrolyzed or lower alkyl-esterified form of a poly(methyl vinyl ether/maleic anhydride) copolymer, in the range of 30 weight percent polyvinylpyrrolidone to 70 weight percent neutralized second polymer to 75 weight percent polyvinylpyrrolidone to 31 weight percent neutralized second polymer; and wherein each color-forming layer is sensitized to a portion of the spectrum at least 60 nm different from the other color-forming layer, and each color-forming layer contains a silver source, silver halide, and a leuco dye which when oxidized forms a dye having a maximum absorbance at least 60 nm different from that of the dye formed in the other color-forming layer, and the barrier polymer is impervious to the solvent system of any adjacent color-forming layer.

2. The construction according to claim 1 wherein said range of polyvinylpyrrolidone to neutralized second polymer, is 55 weight percent polyvinylpyrrolidone/45 weight percent neutralized second polymer to 69 weight percent polyvinylpyrrolidone/31 weight percent neutralized second polymer.

3. The construction according to claim 1 wherein said second polymer is selected from the group consisting of poly(methyl vinyl ether/maleic anhydride), hydrolyzed poly(methyl vinyl ether/maleic acid), monoethyl ester of poly(methyl vinyl ether/maleic acid), monoisopropyl ester of poly(methyl vinyl ether/maleic acid), and monobutyl ester of poly(methyl vinyl ether/maleic acid).

4. The construction according to claim 3 wherein said second polymer is the monoethyl ester of poly(methyl vinyl ether/maleic acid).

5. The construction according to claim 1 wherein said color-forming systems and said barrier polymer are coated simultaneously.

6. The construction according to claim 1 wherein said barrier polymer is coated out of an organic solvent which comprises at least 50 weight percent lower alkyl alcohol.

7. The construction according to claim 1 wherein said lower alkyl alcohol is methanol.

8. The construction according to claim 1 further comprising a third, different, spectrally sensitized, color-forming layer coated out of a lower alkyl alcohol solvent system overlying said second color-forming layer.

9. The construction according to claim 8 further comprising a second barrier layer impervious to alcohol between said second and said third color-forming layer.

10. The construction according to claim 1 further comprising a second barrier layer and a third color-forming layer underlying said first color-forming layer, said second barrier layer being impervious to the solvent of said first color-forming layer.

11. The construction of claim 1 wherein the binder for at least one of said photothermographic layers comprises polyvinyl butyral.

12. The construction of claim 8 wherein the binder for at least one of said photothermographic layers comprises polyvinyl butyral.

13. The article of claim 10 wherein the binder for at least one of said photothermographic layers comprises polyvinyl butyral.

14. The article of claim 8 wherein at least one of said photothermographic layers further comprises a toner.

15. The article of claim 10 wherein at least one of said photothermographic layers further comprises a toner.

16. The article of claim 8 wherein said toner comprises phthalizine in combination with an acid selected from the group consisting of (a) phthalic acid and (b) derivatives of phthalic acid.

17. The article of claim 10 wherein said toner comprises phthalizine in combination with an acid selected from the group consisting of (a) phthalic acid and (b) derivatives of phthalic acid.

* * * * *

UNITED STATES PATENT AND TRADEMARK OFFICE

CERTIFICATE OF CORRECTION

PATENT NO. : 4,452,883

DATED : June 5, 1984

INVENTOR(S) : Frenchik, et al.

It is certified that error appears in the above-identified patent and that said Letters Patent is hereby corrected as shown below:

Column 6, line 43 after "are" insert --not--

Column 14 line 1 before the formula insert
--PART 1 0.26 g indoaniline leuco dye--

Column 14 line 9 after the formula insert
--
PART 2 6.31 g ethanol
0.30 g phthalic acid
13.0 g toluene
3.95 g ethanol --

Signed and Sealed this

Nineteenth Day of February 1985

[SEAL]

*Attest:*

DONALD J. QUIGG

*Attesting Officer* *Acting Commissioner of Patents and Trademarks*

UNITED STATES PATENT AND TRADEMARK OFFICE

CERTIFICATE OF CORRECTION

PATENT NO. : 4,452,883

DATED : June 5, 1984

INVENTOR(S) : Robert A. Frenchik and Kristen A. Hoff

It is certified that error appears in the above-identified patent and that said Letters Patent is hereby corrected as shown below:

column 15, line 3 delete "31" and insert therefor --25--.

Signed and Sealed this

*Ninth* Day of *September 1986*

[SEAL]

*Attest:*

DONALD J. QUIGG

*Attesting Officer*

*Commissioner of Patents and Trademarks*